US010996591B2

(12) United States Patent
Nakaegawa

(10) Patent No.: US 10,996,591 B2
(45) Date of Patent: May 4, 2021

(54) IMAGE FORMING APPARATUS

(71) Applicant: CANON KABUSHIKI KAISHA, Tokyo (JP)

(72) Inventor: Tohru Nakaegawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/682,597

(22) Filed: Nov. 13, 2019

(65) Prior Publication Data

US 2020/0159146 A1 May 21, 2020

(30) Foreign Application Priority Data

Nov. 15, 2018 (JP) ..... JP2018-215112

(51) Int. Cl.
*G03G 15/16* (2006.01)

(52) U.S. Cl.
CPC ..... *G03G 15/1605* (2013.01); *G03G 15/1675* (2013.01)

(58) Field of Classification Search
CPC ..... G03G 15/1605; G03G 15/1675
See application file for complete search history.

(56) References Cited

U.S. PATENT DOCUMENTS 8,532,514 B2 9/2013 Shida
9,304,450 B2 4/2016 Matsuura

FOREIGN PATENT DOCUMENTS

EP 1473603 A1 * 11/2004 ..... G03G 15/1675
JP 2004-117920 A 4/2004
JP 2011-039428 A 2/2011
JP 2015-038580 A 2/2015

* cited by examiner

*Primary Examiner* — Ryan D Walsh
(74) *Attorney, Agent, or Firm* — Venable LLP

(57) ABSTRACT

An image forming apparatus includes an image bearing member, a transfer member forming a transfer portion, a transfer voltage applying device, a sensor, and a controller. The controller is capable of executing an operation in a first setting mode before a preparatory operation, and executes, in the preparatory operation, an operation in a second setting mode in which test voltages or test currents fewer in number of levels than those in the first setting mode are supplied to the transfer portion and in which a second voltage-current characteristic is acquired on the basis of a first voltage-current characteristic in the operation in the first setting mode and a detection result of the sensor detected during supply of the test voltages or the test currents, and then sets the transfer voltage on the basis of the second voltage-current characteristic.

6 Claims, 5 Drawing Sheets

IMAGE FORMING APPARATUS

FIELD OF THE INVENTION AND RELATED ART

The present invention relates to an image forming apparatus, such as a copying machine, a printer or a facsimile machine, of an electrophotographic type, an electrostatic recording type or the like.

In the image forming apparatus of the electrophotographic type or the like, a transfer portion where a toner image receiving member (intermediary transfer member or a recording material such as paper) is sandwiched between an image bearing member (photosensitive member, intermediary transfer member) and a transfer member, is formed, and a toner image is transferred from the image bearing member onto the toner image receiving member. During transfer, a transfer voltage is applied to the transfer member. In such an image forming apparatus, an operation in a setting mode, in which the transfer voltage applied to the transfer member during transfer is set in advance of the transfer, is carried out in some instances.

In the operation in this setting mode, for example, the transfer voltage corresponding to a target value (target transfer current) of a transfer current is set on the basis of a voltage-current characteristic acquired by applying test voltages or test currents of a plurality of levels (settings, kinds) to the transfer member when the transfer is not carried out. According to the operation in this setting mode, the transfer voltage can be adjusted so as to pass a predetermined transfer current through the transfer portion, depending on electrical resistance values of the transfer member and the image bearing member different from a difference among individuals, an environment (temperature, humidity) and a use history (cumulative voltage application time). This setting mode is also called ATVC (automatic transfer voltage control).

Japanese Laid-Open Patent Application 2004-117920 discloses the following ATVC. That is, immediately before a start of image formation, in a state in which a recording material is absent at a transfer portion, test voltages of two or more levels are applied to a transfer member and currents at that time are detected, and a voltage-current characteristic is acquired. Then, on the basis of the voltage-current characteristic, a transfer voltage corresponding to a target transfer voltage is determined.

With speed-up of the image forming apparatus in recent years, a demand for a first copy time (FCOT) has been increased. The FCOT refers to a time from input of an image formation start instruction until a first sheet of a recording material on which an image is formed is outputted. As in the above-described conventional method, in the case where the ATVC is carried out immediately before the start of the image formation, for example, in order to shorten the FCOT in an image forming apparatus of a tandem type, the following is desired. That is, it is desired that the ATVC at a secondary transfer portion is ended before a toner image reaches the secondary transfer portion from a most downstream primary transfer portion with respect to a movement direction of a surface of an intermediary transfer member. This is because in the case where a most downstream image forming portion is an image forming portion for black or in the like case, the FCOT can be shortened even in an operation in a black (monochromatic) mode.

Here, for example, as regards a transfer roller which is frequently used as the transfer member, due to a manufacturing error or the like, transfer rollers vary in electrical resistance with respect to a circumferential direction in some instances. For that reason, it is desirable that a test voltage or a test current for each (one) of levels is applied during at least one-full-circumference (one-full turn) of the transfer roller and then a detection result of currents or voltages at that time is averaged. Accordingly, in the case where test voltages or test currents of a plurality of levels are applied in a short time in order to shorten the FCOT as described above, the number of the levels of the test voltages or the test currents is limited in some instances. In that case, accuracy of a voltage-current characteristic acquired in the operation in the setting mode lowers, so that a difference between a target transfer current and an actually supplied transfer current becomes large in some instances. As a result, there is a liability that excess and deficiency generate in the transfer current, and thus an image defect such as a "decrease in image density" or a "white void" occurs. The "decrease in image density" is a phenomenon that the transfer current becomes insufficient and transfer is not sufficiently carried out and thus a desired image density cannot be obtained. Further, the "white void" is a phenomenon that electric discharge generates at the transfer portion due to excess of the transfer current and a polarity of electric charges of toner of the toner image is reversed by the influence of the electric discharge and thus the toner image is not partially transferred.

SUMMARY OF THE INVENTION

Accordingly, a principal object of the present invention is to provide an image forming apparatus capable of shortening a time from input in an image formation start instruction until a recording material which is a first sheet on which an image is formed is outputted, while improving accuracy of setting of a proper transfer voltage.

According to an aspect of the present invention, there is provided an image forming apparatus comprising: an image bearing member configured to bear a toner image; a transfer member configured to transfer the toner image from said image bearing member onto a toner image receiving member at a transfer portion; an applying device configured to apply a transfer voltage, for transferring the toner image, to said transfer portion; a sensor configured to detect a current or a voltage when the voltage is applied to said transfer portion by said applying device; and a controller configured to execute an operation in a first mode in which first test voltage or first test current of three or more levels are supplied to said transfer portion after main switch actuation before an image formation, and configured to execute an operation in a second mode in which second test voltage or second test current smaller in number of levels than those in the first mode are supplied to said transfer portion in a preparatory period from a reception of an image formation start instruction until an image formation of a first sheet is started, and wherein the controller acquires a first voltage-current characteristic on the basis of a detection result of said sensor detected in the operation in the first mode, and acquires a second voltage-current characteristic on the basis of the first voltage-current characteristic and a detection result of said sensor detected in the operation in the second mode, and sets the transfer voltage on the basis of the second voltage-current characteristic Further features of the present invention will become apparent from the following description of exemplary embodiments with reference to the attached drawings.

DESCRIPTION OF EMBODIMENTS

An image forming apparatus according to the present invention will be specifically described with reference to the drawings.

Embodiment 1

1. General Structure and Operation of Image Forming Apparatus

Figure 1:
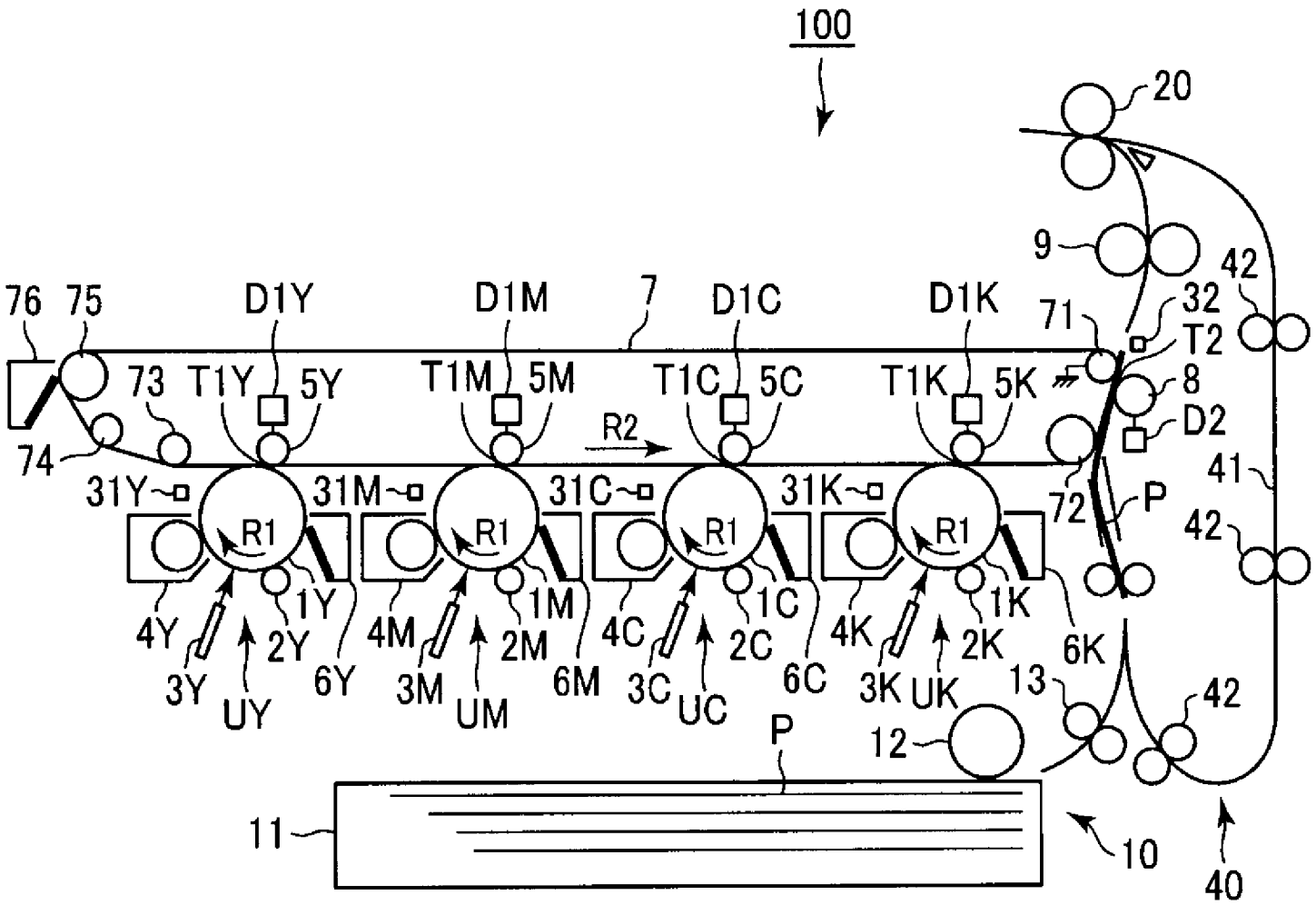
FIG. 1 is a schematic sectional view of an image forming apparatus.

FIG. 1 is a schematic sectional view of an image forming apparatus 100 of the present invention.

The image forming apparatus 100 in this embodiment is a tandem multi-function machine (having functions of a copying machine, a printer and a facsimile machine), which is capable of forming a full-color image and is of an electrophotographic type and an intermediary transfer type.

The image forming apparatus 100 includes first to fourth image forming units UY, UM, UC and UK for forming images of yellow (Y), magenta (M), cyan (C) and black (K). As regards elements of the respective image forming units UY, UM, UC and UK having the same or corresponding functions or constitutions, suffixes Y, M, C and K for representing the elements for associated colors are omitted, and the elements will be collectively described in some instances. The image forming unit U is constituted by including a photosensitive drum 1, a charging roller 2, an exposure device 3, a developing device 4, a primary transfer roller 5, a cleaning device 6 and the like, which are described later.

The photosensitive drum 1 which is a rotatable drum-shaped photosensitive member (electrophotographic photosensitive member) as a first image bearing member for bearing a toner image is rotationally driven at a predetermined peripheral speed in an arrow R1 direction (clockwise direction) in the figure. A surface of the rotating photosensitive drum 1 is electrically charged uniformly to a predetermined polarity (negative in this embodiment) and a predetermined potential by the charging roller 2 which is a roller-type charging member as a charging means. The charged surface of the photosensitive drum 1 is subjected to scanning exposure to light depending on image data (image information signal) by the exposure device (laser scanner) 3 as an exposure means, so that an electrostatic image (electrostatic latent image) depending on the image data is formed on the photosensitive drum 1. The electrostatic image formed on the photosensitive drum 1 is developed (visualized) by supplying toner as a developer by the developing device 4 as a developing means, so that a toner image (developer image) depending on the image data is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged.

As a second image bearing member for bearing the toner image, an intermediary transfer belt 7 which is constituted by a rotatable endless belt and which is an intermediary transfer member is provided so as to oppose the four photosensitive drums 1. The intermediary transfer belt 7 is extended around and stretched by a plurality of stretching rollers (supporting rollers) including a driving roller 71, first to third idler rollers 72, 73 and 74, and a tension roller 75. The intermediary transfer belt 7 is driven and circulated (rotationally driven) in an arrow R2 direction (counterclockwise direction) in FIG. 1 by the driving roller 71. The driving roller 71 is driven by a motor excellent in constant-speed property and circulates and moves (rotates) the intermediary transfer belt 7. In this embodiment, the driving roller 71 also functions as an opposing electrode (secondary transfer opposite roller, inner secondary transfer roller) to a secondary transfer roller (outer secondary transfer roller) 8 described later. The first to third idler rollers 72, 73 and 74 support the intermediary transfer belt 7 extending along an arrangement direction of the photosensitive drums 1Y, 1M, 1C and 1K. The tension roller 75 applies a substantially certain tension to the intermediary transfer belt 7. In this embodiment, the tension of the intermediary transfer belt 7 relative to the tension roller 75 is about 3-12 kgf. On the inner peripheral surface side of the intermediary transfer belt 7, the primary transfer rollers 5, which are roller-type primary transfer members as primary transfer means, are disposed correspondingly to the respective photosensitive drums 1. The primary transfer roller 5 is urged toward an associated photosensitive drum 1 side through the intermediary transfer belt 7, whereby a primary transfer portion (primary transfer nip) T1 where the photosensitive drum 1 and the intermediary transfer belt 7 contact each other is formed.

The toner image formed on the photosensitive drum 1 as described above is primary-transferred onto the rotating intermediary transfer belt 7 at the primary transfer portion T1 by the action of the primary transfer roller 5. During the primary transfer step, to the primary transfer roller 5, a primary transfer voltage (primary transfer bias) which is a DC voltage of an opposite polarity (positive in this embodiment) to a normal charge polarity of the toner (charge polarity of the toner during development) is applied by a primary transfer voltage source (high voltage source circuit) D1. For example, during full-color image formation, the color toner images of Y, M, C and K formed on the respective photosensitive drums 1 are successively primary-transferred superposedly onto the intermediary transfer belt 7 at the respective primary transfer portions T1.

On an outer peripheral surface side of the intermediary transfer belt 7, at a position opposing the driving roller (also functioning as the secondary transfer opposite roller) 71, the secondary transfer roller 8 which is a roller-type secondary transfer member as a secondary transfer means is provided. The secondary transfer roller 8 is urged toward the driving roller 71 through the intermediary transfer belt 7 and forms a secondary transfer portion (secondary transfer nip T2 where the intermediary transfer belt 7 and the secondary transfer roller 8 contact each other. The toner images formed on the intermediary transfer belt 7 as described above are secondary-transferred onto a recording material (transfer material, sheet) P such as paper sandwiched and fed by the intermediary transfer belt 7 and the secondary transfer roller 8 at the secondary transfer portion T2 by the action of the secondary transfer roller 8. During the secondary transfer step, to the secondary transfer roller 8, a secondary transfer voltage (secondary transfer bias) which is a DC voltage of the opposite polarity to the normal charge polarity of the toner is applied by a secondary transfer voltage source (high voltage source circuit) D2. The driving roller 71 is electrically grounded (i.e., connected to the ground). Incidentally, a constitution in which a roller corresponding the driving roller 71 in this embodiment is used as a transfer member and to this roller, a secondary transfer voltage of the same polarity as the normal charge polarity of the toner is applied and in which a roller corresponding to the secondary transfer roller 8 in this embodiment is used as an opposite electrode and is electrically grounded may also be employed.

The recording material P is fed to the secondary transfer portion T2 by a recording material supplying device 10 as a recording material supplying portion. The recording material supplying device 10 includes a recording material accommodating portion (cassette, tray or the like) 11 for accommodating the recording material P, a pick-up roller 12 for feeding the recording material P one by one at predetermined timing, a feeding roller pair 13 for feeding the fed recording material P, and the like. The recording material P fed by the feeding roller pair 13 is fed toward the secondary transfer portion T2 by being timed to the toner images on the intermediary transfer belt 7 by a registration roller pair 50 as a registration correcting portion.

The recording material P on which the toner images are transferred is fed toward a fixing device 9 as a fixing means. The fixing device 9 heats and presses the recording material P carrying thereon unfixed toner images, and thus fixes (melt-fixes) the toner images on the recording material P. In the case where an image forming mode is a one-side mode (one-side printing) in which the image is formed on only one side (surface) of the recording material P, the recording material P on which the toner images are fixed on one side (surface) thereof is discharged (outputted) to an outside of an apparatus main assembly of the image forming apparatus 100 by a discharging roller pair 20 as a discharging portion.

In the case where the image forming mode is an automatic double-side mode (automatic double-side printing) in which the images are formed on double (both) sides (surfaces) of the recording material P, the recording material P on which the image is formed (the toner image is fixed) on a first side (surface) is fed again to the secondary transfer portion T2 by a double-side feeding device 40. In the case of the automatic double-side mode, the discharging roller pair 20 is reversed at predetermined timing before the recording material P on which the image is formed on the first side is discharged to the outside of the image forming apparatus. As a result, the recording material P is guided into a reverse path (double-side feeding path) 41 of the double-side feeding device 40. The recording material P guided into the reverse path 41 is fed toward the registration roller pair 50 by a re-feeding roller pair 42. Similarly as in the case of the image formation on the first side, this recording material P is fed to the secondary transfer portion T2 by being timed to the toner images on the intermediary transfer belt 7 by the registration roller pair 50, so that the toner images are secondary transferred onto a second side (surface) opposite from the first side. The recording material P on which the toner images are transferred on the second side is discharged to the outside of the image forming apparatus by the discharging roller pair 20 after the toner images are fixed on the second side of the recording material P by the fixing device 9.

Further, toner (primary transfer residual toner) remaining on the photosensitive drum 1 without being transferred onto the intermediary transfer belt 7 during the primary transfer step is removed and collected from the photosensitive drum 1 by a drum cleaning device 106 as a photosensitive member cleaning means. Further, on the outer peripheral surface side of the intermediary transfer belt 7, at a position opposing the tension roller 75, a belt cleaning device 76 as an intermediary transfer member cleaning means is provided. Toner (secondary transfer residual toner) remaining on the intermediary transfer belt 7 without being transferred onto the recording material P during the secondary transfer step, and paper powder are removed and collected from the surface of the intermediary transfer belt 7 by the belt cleaning device 76.

In this embodiment, the primary transfer roller 5 is a roller which has a metal core (core material, central axis), and an elastic layer formed of conductive foam rubber as an elastic material so as to cover the outer periphery of the core metal. In this embodiment, the primary transfer roller 5 has an outer diameter of 17.5 mm and an electrical resistance value adjusted to $1.0\times10^{7}$ Ω. The primary transfer roller 5 is pressed upward in the vertical direction in this embodiment by a pressure spring functioning as an urging means, and presses against the photosensitive drum 1 so as to sandwich the intermediary transfer belt 7 with a predetermined pressure, by which the primary transfer portion T1 is formed.

In addition, in this example, as the intermediary transfer belt 7, a resin such as polyimide or polyamide, or various rubbers containing an appropriate amount of a conductive filler such as carbon or an ionic conductive material dispersed is used. The intermediary transfer belt 7 is formed so that its surface resistivity is $1\times10^{9}$×to $1\times10^{12}$ Ω/□.. In addition, the intermediary transfer belt 7 is a film-like endless belt having a thickness of about 0.04 to 0.5 mm, for example.

In addition, in this, the driving roller (also serving as a secondary transfer counter roller) 71 includes a metal core, an elastic layer formed of EPDM rubber as an elastic material covering the outer periphery of the core metal. In this embodiment, the drive roller 71 has an outer diameter of 16 mm, an elastic layer thickness of 0.5 mm, and a hardness of 70° (Asker C), for example.

In addition, in this embodiment, the secondary transfer roller 8 includes a core metal, an elastic layer formed of NBR rubber or EPDM rubber as an elastic material covering the outer periphery of the core metal. In this embodiment, the secondary transfer roller 8 has an outer diameter of 20 mm. The secondary transfer power supply D2 is connected with the secondary transfer roller 8, and the applied voltage to the secondary transfer roller 8 is variable.

In addition, in this embodiment, the image forming apparatus 100 comprises a first temperature humidity sensor 31 (31Y, 31M, 31C, 31K) which detects the temperature and humidity around the primary transfer portion T1, and a second temperature humidity sensor 32 which detects the temperature and humidity around the secondary transfer portion T2. The control unit 50, which will be described later, can adjust the toner image forming conditions and transfer conditions according to the environmental condition classification selected based on the outputs of the first and second temperature and humidity sensors 31, 32.

2. Control Mode

Figure 2:
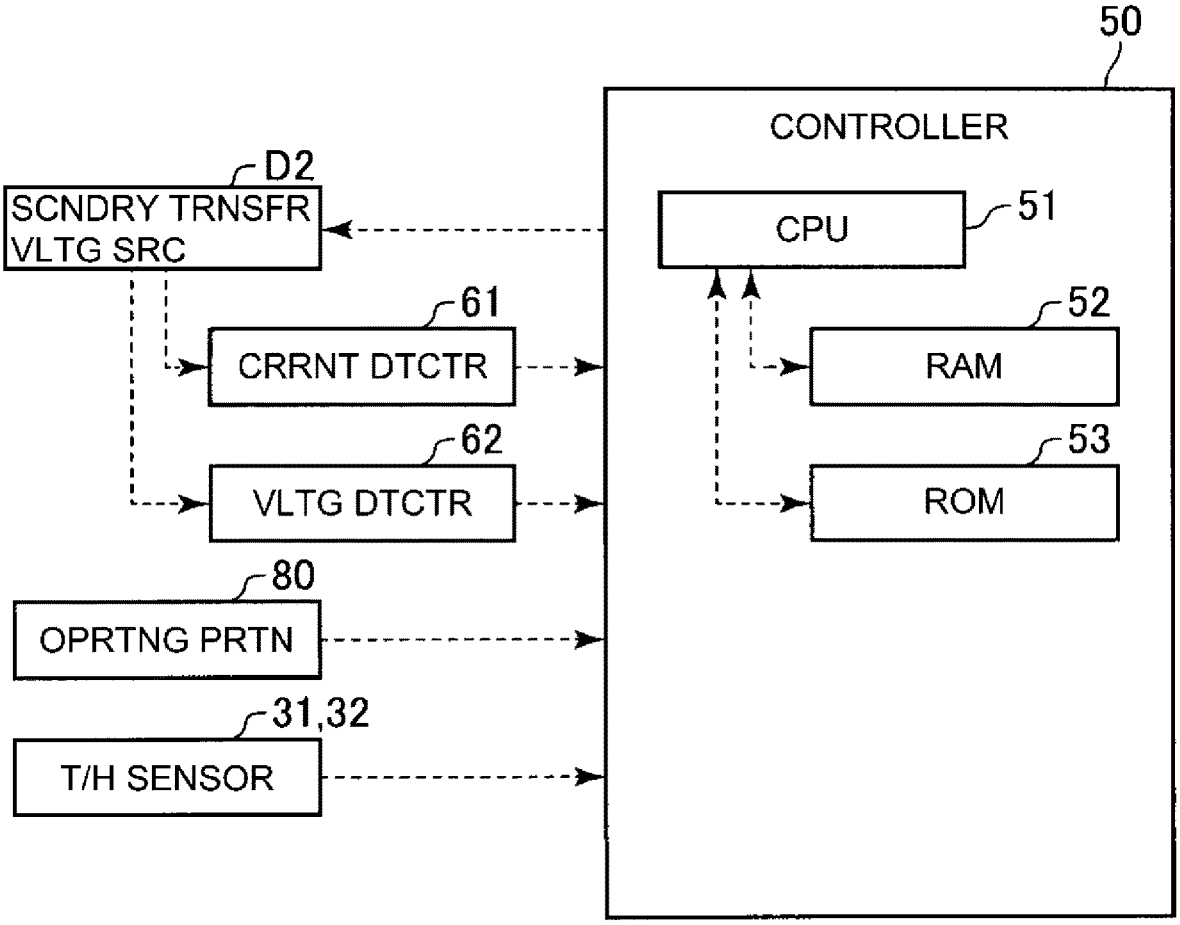
FIG. 2 is a schematic control block diagram showing a control mode of a principal part of the image forming apparatus.

FIG. 2 is a schematic block illustration of a control mode of a major part of the image forming apparatus 100 in this embodiment. A control unit (control circuit) 50 as control means includes a CPU 51 as processing control means, and memory (storage medium) such as RAM 52 and ROM 53 as storage means. A rewritable memory RAM 52 temporarily stores various data such as information inputted to the control unit 50 such as the number of printed sheets, which varies depending on the image forming operation, the detected information, and a calculation result, and they are used for various controls by the CPU 51. In addition, ROM 53 stores, in a control program, set values required for various controls (data table obtained in advance), and they are called by the CPU 51 as needed.

Connected to the control unit 50 is an image reading device (not shown) provided in the image forming apparatus 100 or an external device (not shown) such as a personal computer. In addition, an operation unit (operation panel) 80 provided in the image forming apparatus 100 is connected to the control unit 50. The operation 80 includes a display portion which displays various information to the operator such as users and service personnel under the control of the control unit 50, and an input portion for the operator to input various settings related to image formation to the control unit 50. In this embodiment, the operator can designate operation settings such as the type of recording material P used for image formation from the operation unit 80 or an external device. Here, the control unit 80 may recognize that the type of the recording material P used for image formation is a predetermined type set in advance in case the recording material P is not designated by the operator. In addition, connected to the control unit 50 are a secondary transfer power source D2 as a voltage application means, a current detection circuit 61 as current detection means, and a voltage detection circuit 62 as voltage detection means. Detection results (output signals) of the current detection circuit 61 and the voltage detection circuit 62 are inputted to the control portion 50. In addition, first and second temperature humidity sensors 31 and 32 are connected to the controller 50. In this embodiment, the first and second temperature humidity sensors 31 and 32 detect the temperature and humidity around the primary transfer portion T1 and around the secondary transfer portion T2 in the casing of the image forming apparatus 100, respectively. Temperature and humidity information detected by the first and second temperature humidity sensors 31 and 32 is inputted to the control unit 50. The first and second temperature humidity sensors 31 and 32 are examples of environment detection means for detecting at least one of temperature and or humidity inside or outside the image forming apparatus 100.

The control unit 50 overall controls each portion of the image forming device 100 to execute an image forming operation, on the basis of image information from the image reading device or the external device and control commands from the operation unit 80 or the external device. An operator such as a user or a service person can execute an image forming operation by operating an operation device 80 or an external device connected to the image forming apparatus 100. The control unit 50 operates the various devices of the image forming apparatus 100 in response to signals from the operation unit 80 and external devices operated by the operator.

Here, the image forming apparatus 100 executes a job (print operation), which is a series of operations to form and output an image on single or multiple recording materials P, which is started by one image formation start instruction (print instruction). A job generally includes the image forming process, a pre-rotating process, a paper-to-paper interval process (inter-sheet process) (when images are formed on a plurality of recording materials P), and a post-rotating process. The image forming process is executed in the period during which the electrostatic image formation, the toner image formation, the toner image primary transfer, and the secondary transfer of the toner image onto the recording material P are performed, and the time of image formation (image formation period) refers to this period. In more detail, the timing at which the image is formed differs depending on the position at which the electrostatic image formation, toner image formation, toner image primary transfer, and secondary transfer steps are performed. In the pre-rotation process, the preparatory operations before the image formation process are performed after the image formation start instruction is inputted until the actual image formation starts. The inter-sheet process is executed in a period corresponding to between the recording material P and the next recording material P when image formation is continuously performed on a plurality of recording materials P (continuous image formation). In the post-rotation process, the rearranging operation (preparing operation for the next image forming operation) after the image forming process is performed. Non-image formation (non-image-formation period) is a period other than image formation period, and includes the above-mentioned pre-rotation process, the inter-paper process, and the post-rotation process. It includes a multiple pre-rotation process that is a preparatory action immediately after the image forming apparatus 100 is turned on, or immediately after recovery from a jam clearance operation. Here, the sleep state is a state in which, for example, power is supplied only to the control unit 50 or a portion thereof, and the power supply to the other elements of the image forming apparatus 100 is stopped to save the power consumption. In addition, the jam clearance operation is an operation for removing a jammed recording material P when the recording material P is jammed in the feeding path of the recording material P in the image forming apparatus 100. In this embodiment, in the non-image formation period, a secondary transfer voltage control for setting the secondary transfer voltage is executed.

3. Secondary Transfer Voltage Control

<Outline of Secondary Transfer Voltage Control>

In this embodiment, when there is no toner image or recording material P in the secondary transfer portion T2, an ATVC control operation is executed in which information on the electrical resistance of the secondary transfer portion T2 (mainly the secondary transfer roller 8 in this embodiment) is acquired, and the partial secondary transfer partial voltage Vb is set (setting mode). That is, with the secondary transfer roller 8 and the intermediary transfer belt 7 in contact with each other, a predetermined test voltage or test current is applied to the secondary transfer roller 8 from the secondary transfer power source D2. And, the current at the time of applying the predetermined test voltage or the voltage at the time of applying the predetermined test current is detected, and the voltage-current characteristic that is the relationship between the voltage and the current is acquired. This voltage-current characteristic varies depending on the electrical resistance of the secondary transfer portion T2. In the image forming apparatus 100 of this embodiment, this voltage-current characteristic changes so that the current can be expressed by a second or higher order polynomial of the voltage. Therefore, in this embodiment, in order to obtain this voltage-current characteristic with high accuracy, in the setting mode, it is desirable to apply the test voltages or currents of 3 different levels.

However, when the number of test voltages or test voltage levels increases, it takes longer time to set the secondary transfer partial voltage Vb, with the possible result of adversely affecting the image output productivity.

In view of this, in this embodiment, the following first setting mode and second setting mode can be executed. The first setting mode is a mode in which the control time is relatively long, and is executed in the multiple pre-rotation process. The second setting mode is a mode in which the control time is shorter than the first setting mode, and is executed in the pre-rotation process immediately before the start of image formation. In the first setting mode, the first voltage-current characteristics are acquired based on the data acquired using test voltages or test currents of 3 levels or more. In the second setting mode, the second voltage-current characteristic is acquired on the basis of the data acquired using a lower number of test voltages or test currents than in the first setting mode and the first setting mode (typically based on the result of the first setting mode performed in the most recent period). In addition, in this embodiment, Vb+Up provided by adding the secondary transfer partial load Vb based on the second voltage-current characteristic acquired in the second setting mode and a preset recording material part voltage Up is set as a secondary transfer voltage to be applied to the secondary transfer roller 8 under a constant-voltage-control during the secondary transfer. Here, in the constant voltage control, the output of the power supply is controlled so that the applied voltage is substantially constant at the target value.

<First Setting Mode>

Figure 3:
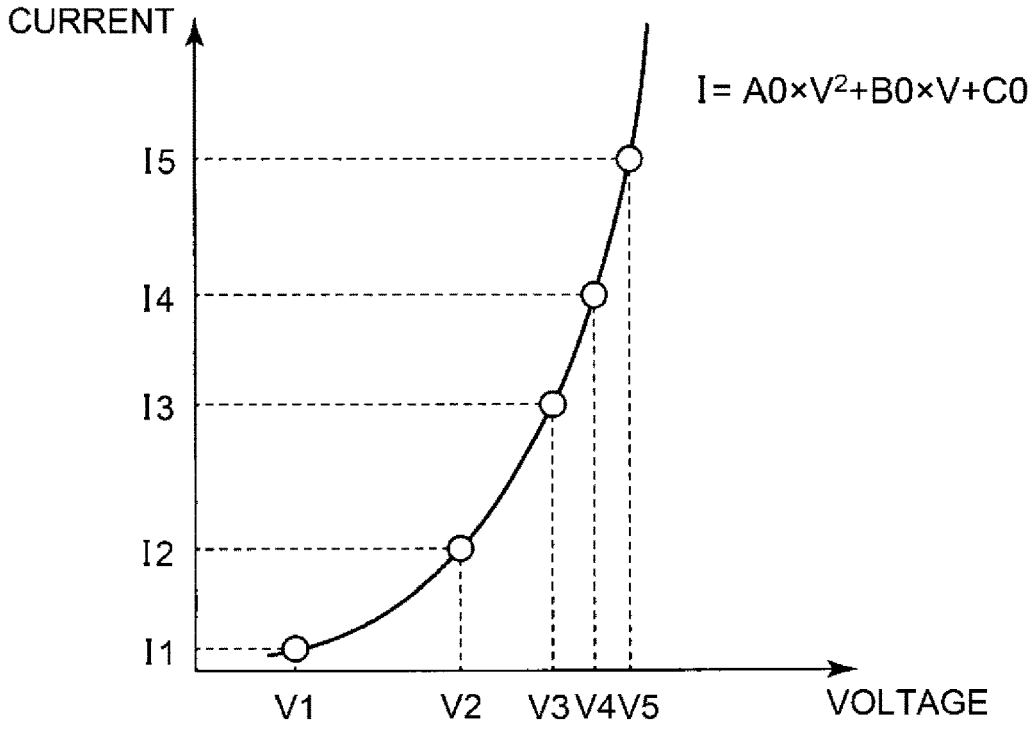
FIG. 3 is a graph for illustrating an acquiring method of a first voltage-current characteristic in an operation in a first setting mode.

FIG. 3 is a graph for explaining a method for obtaining the voltage-current characteristic of the secondary transfer portion T2 in the first setting mode. This Figure shows the first voltage-current characteristics required in the first setting mode.

In this embodiment, at the time of multiple pre-rotations immediately after the main switch of the image forming apparatus 100 is turned on, the control unit 50 executes a first setting mode in which a test voltage or a test current of three levels or more is applied to the secondary transfer roller 8. At this time, the surface of the photosensitive drum 1 is cleaned, the surface potential is made uniform, and the fixing roller and the pressure roller of the fixing device 9 are heated. Here, the timing for executing the first setting mode is not limited to the multiple pre-rotations immediately after the power is turned on, and it may be executed immediately before returning from the sleep state, immediately after the jam clearance operation, at the time of multiple pre-rotations, or at the time of post-rotation. Here, by executing the first setting mode, simultaneously with other controls such as cleaning the surface of the photosensitive drum 1, making the surface potential uniform, heating the fixing roller and pressure roller of the fixing device 9, a decrease in productivity due to the execution of the first setting mode can be suppressed.

In this embodiment, in the first setting mode, five levels of test voltage or test current are applied to determine the first voltage-current characteristics. The control unit 50 applies a predetermined test current to the first point and the second point, as counting as the first point from the side where the absolute value of voltage is small, and after the third point, the test voltage or the test current is switched according to the electrical resistance of the secondary transfer portion T2 based on the data acquired at the first point. For example, when the electrical resistance of the secondary transfer portion T2 based on the data acquired at the first point is greater than or equal to a predetermined value, a predetermined test voltage is applied at and after the third point. By this, it is possible to suppress an excessive current from flowing through the secondary transfer portion T2. However, the present invention is not limited to such an application mode of the test voltage or test current. For example, only a predetermined test voltage or test current may be applied. In addition, in this embodiment, the test voltage or the test current for each level continues to be applied, while the secondary transfer roller 8 makes one full rotation, and the output value of the current detection circuit 61 or the voltage detection circuit 46 during that period is averaged by the control unit 50, and the average is used as a detection result for each level. The test voltage or test current is applied for more than one full rotation of the secondary transfer roller 8, and therefore, even if there is a variation in the electrical resistance in the circumferential direction of the secondary transfer roller 8, the data is averaged, and the information regarding the electrical resistance of the secondary transfer portion T2 can be acquired with high accuracy. However, even when the test voltage or test current is applied for less than one full rotation of the secondary transfer roller 8, the same effect as in this embodiment can be provided. Here, in this embodiment, the number of the test voltage or test current in the first setting mode is set to five levels, but it may be three levels or more. The number of this level can be selected as appropriate from the standpoint that voltage-current characteristics can be acquired with sufficient accuracy and that the time required for control is not made longer than necessary, and typically, 10 levels or less are often sufficient.

When the voltage is V and the current is I, the control unit 50 approximates the first voltage-current characteristic with a quadratic curve of Equation 1 from the five sets of voltage and current data acquired using the five levels of test voltage or test current. And, the control unit 50 causes the RAM 52 to store the acquired information on the first voltage-current characteristic. Here, in this embodiment, the control unit 50 calculates the coefficients A0, B0, and C0 in Equation 1 by the least square method using Equation 2, Equation 3, and Equation 4, respectively. Here, in Equation 2, equation 3, and Equation 4, $$\sum V$$

means $$\left(\sum_{n=1}^{5} V\right).$$

And this applies to the other.

$$I = A0 \times V^2 + B0 \times V + C0 \tag{1}$$

$$A0 = \frac{\sum I \sum V^2 \sum V^2 I - \sum V \sum V \sum V^2 I + \sum V \sum V^2 \sum VI - \sum I \sum V^3 \sum VI + \sum V \sum V^3 \sum I - \sum V^2 \sum V^2 I}{2\sum V \sum V^2 \sum V^3 + \sum 1 \sum V^2 \sum V^4 - \sum V \sum V \sum V^4 - \sum I \sum V^3 \sum V^3 - \sum V^2 \sum V^2 \sum V^2} \tag{2}$$

$$B0 = \frac{\sum V \sum V^2 \sum V^2 I - \sum I \sum V^3 \sum V^2 I + \sum I \sum V^4 \sum VI - \sum V^2 \sum V^2 \sum VI + \sum V^2 \sum V^3 \sum I - \sum V \sum V^4 \sum I}{2\sum V \sum V^2 \sum V^3 + \sum I \sum V^2 \sum V^4 - \sum V \sum V \sum V^4 - \sum I \sum V^3 \sum V^3 - \sum V^2 \sum V^2 \sum V^2} \tag{3}$$

-continued $$C0 = \frac{-\sum V^2 \sum V^2 \sum V^2 I + \sum V \sum V^3 \sum V^2 I - \sum V \sum V^4 \sum VI + \sum V^2 \sum V^3 \sum VI - \sum V^3 \sum V^3 \sum I + \sum V^2 \sum V^4 \sum I}{2\sum V \sum V^2 \sum V^3 + \sum I \sum V^2 \sum V^4 - \sum V \sum V \sum V^4 - \sum I \sum V^3 \sum V^3 - \sum V^2 \sum V^2 \sum V^3} \quad (4)$$

<Second Setting Mode>

Figure 4:
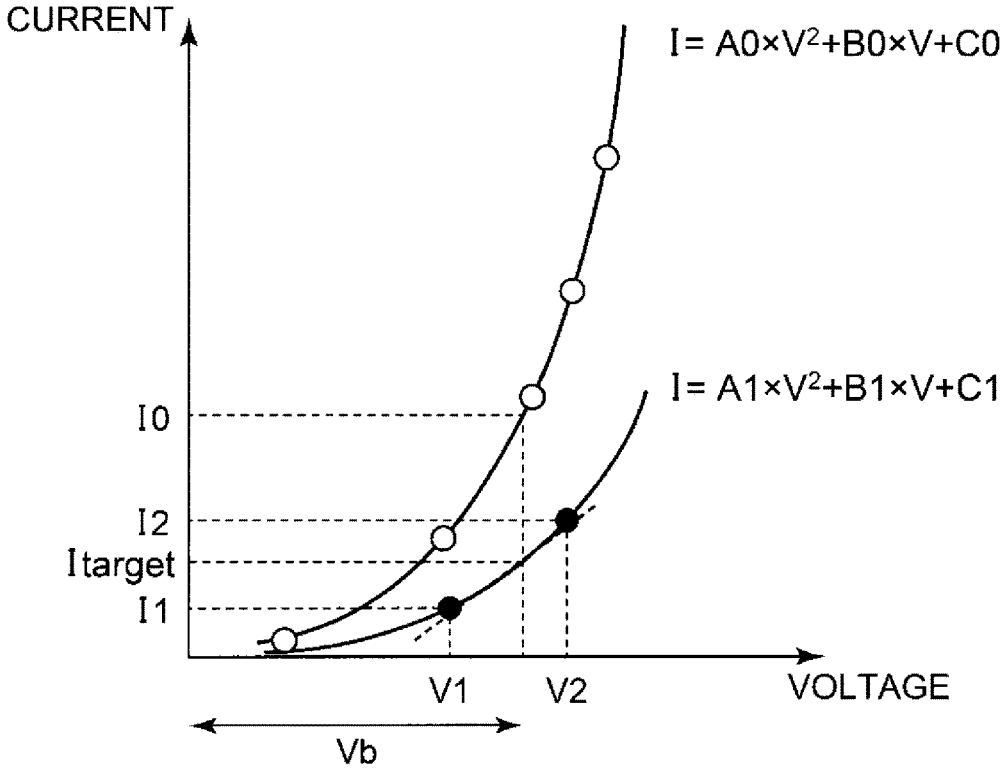
FIG. 4 is a graph for illustrating an acquiring method of a second voltage-current characteristic in an operation in a second setting mode.

FIG. 4 is a graph explaining a method for obtaining the voltage-current characteristic of the secondary transfer portion T2 in the second setting mode. In the Figure, a first voltage-current characteristic (white plot) acquired in the first setting mode and a second voltage-current characteristic (black plot) acquired in the second setting mode are shown.

In this embodiment, after executing the above-described first setting mode, the control unit 50 executes the second setting mode between the time when the toner image reaches the secondary transfer portion T2 from the most downstream primary transfer portion T1K in the moving direction of the surface of the intermediary transfer belt 7 at the time of pre-rotation of each job. In the image forming apparatus 100 of this embodiment, until the toner image reaches the secondary transfer portion T2 from the most downstream primary transfer portion T1K, time for two full rotations of the secondary transfer roller 8 can be assured. Therefore, in this embodiment, in the second setting mode, a two-level test current is applied to the secondary transfer roller 8. And, the test current for each level continues to be applied for one revolution of the secondary transfer roller 8, and during this time, the output value of the voltage detection circuit 46 is averaged by the control unit 50, and the detection result for each level is acquired. Here, in the second setting mode, a predetermined test voltage may be applied, or a predetermined test voltage and a predetermined test current may be applied.

Accordingly, in this embodiment, the control unit 50 calculates the amount of water around the secondary transfer unit T2 (the weight of water per kg of air) based on the temperature and humidity detection results by the second temperature and humidity sensor 32 as environmental information. And, two levels of test currents corresponding to the amount of moisture and the types of recording material P are outputted from the secondary transfer power source D2, and the voltage detection result by the voltage detection circuit 62 is acquired. Table 1 shows two levels of test currents in the second setting mode in this embodiment. The first test current I1 is the target transfer current Itarget in the full color mode according to the type and moisture content of the first recording material P of the job. In addition, the second test current I2 is the current obtained by adding ΔI corresponding to the amount of water to I1. Table 2 shows the preset ΔI for each category of the water amount. In addition, table 3 shows, as an example, information on the target transfer current Itarget preset for each of the full color mode and the black monochromatic mode for each of the water content categories, for plain paper. The information on the target transfer current Itarget as shown in Table 3 is set for each type of recording material P. Here, the type of recording material P includes Ay information that can distinguish the recording material P such as general features including plain paper, thick paper, thin paper, glossy paper, coated paper, or embossed paper, or manufacturer, brand, product number, basis weight, thickness, size or the like. The information for determining the test current as shown in Tables 2 and 3 is preset and stored in the ROM 53. Here, the settings of I1 and I2 are not limited to those of this embodiment, and can be appropriately selected so that the first voltage-current characteristic can be corrected with a desired accuracy. For example, a current obtained by subtracting ΔI corresponding to the amount of water from I1 can be set as I2.

TABLE 1

| Test Current (μA) | |
|---|---|
| I1 (first point) | Target transfer current for printing on the first sheet in the job in full-color mode) |
| I2 (second point) | Current obtained by I1 + ΔI |

TABLE 2

| Environments | 1 | 2 | 3 | 4 | 5 | 6 | 7 |
|---|---|---|---|---|---|---|---|
| Water Content(g/Kg) | 0.86 | 1.73 | 5.8 | 8.9 | 15 | 18 | 21.6 |
| ΔI (μA) | 20.0 | 19.7 | 18.6 | 17.7 | 16.0 | 15.0 | 14.0 |

TABLE 3

| | Environments | 1 | 2 | 3 | 4 | 5 | 6 | 7 |
|---|---|---|---|---|---|---|---|---|
| | Water Content(g/Kg) | 0.86 | 1.73 | 5.8 | 8.9 | 15 | 18 | 21.6 |
| Full-color mode | Single side | 63.0 | 58.1 | 55.0 | 52.1 | 49.7 | 47.1 | 44.0 |
| | Both sides (second side) | 55.0 | 55.0 | 55.0 | 55.0 | 55.0 | 55.0 | 55.0 |
| Monochromatic black mode | Single side | 48.0 | 45.6 | 44.0 | 42.9 | 42.1 | 41.1 | 40.0 |
| | Both sides (second side) | 50.0 | 46.3 | 44.0 | 45.6 | 46.9 | 48.3 | 50.0 |

The control unit 50, as shown in FIG. 4, obtains a secondary transfer partial voltage Vb corresponding to the target transfer current Itarget by linearly approximating the acquired current I1, I2 and voltage V1, V2 data.

As shown in FIG. 4, the control unit 50 obtains the partial secondary transfer voltage Vb corresponding to the target transfer current Itarget, by linearly approximating the acquired current I1, I2 and voltage V1, V2 data. And, the control unit 50 corrects the first voltage-current characteristic shown in Equation 1 acquired in the first setting mode as shown in Equation 5, based on the obtained partial secondary transfer voltage Vb. Here, in this embodiment, the control unit 50 obtains the coefficients A1, B1, and C1 in Equation 5 using Equation 6, Equation 7, and Equation 8, respectively. Here, in Equation 1, the current when voltage V=Vb is I0. In this embodiment, each coefficient A0, B0, C0 in the first voltage-current characteristic shown in Equation 1 is corrected as follows. That is, the correction is made using the ratio of the target transfer current Itarget in the second setting mode, and a current I0 obtained by applying the partial secondary transfer voltage Vb based on the data acquired in the second setting mode to the first voltage-current characteristic shown in Equation 1.

$$I = A1 \times V^2 + B1 \times V + C1 \tag{5}$$

$$A1 = (I_{target} / I0) \times A0 = (\text{I_target}/(A0 \times Vb^2 + B0 \times Vb + C0)) \times A0 \tag{6}$$

$$B1 = (I_{target} / I0) \times B0 = (\text{I_target}/(A0 \times Vb^2 + B0 \times Vb + C0)) \times B0 \tag{7}$$

$$C1 = (I_{target} / I0) \times C0 = (\text{I_target}/(A0 \times Vb^2 + B0 \times Vb + C0)) \times C0 \tag{8}$$

The control unit 50 obtains the second voltage-current characteristic shown in Expression 5 until the recording material P reaches the secondary transfer unit T2. And, for each recording material P that reaches the secondary transfer portion T2, the control unit 50 can obtain the partial secondary transfer voltage Vb, for the target transfer current according to the recording material P (value according to the type of recording material P, the color mode, and the amount of water), by using the second voltage current characteristics. Therefore, for example, even when the color mode (full color mode, black monochromatic mode) and the type of recording material P are mixed in a continuous image formation job, the secondary transfer partial voltage Vb corresponding to the optimum target transfer current Itarget can be obtained.

<Secondary Transfer Voltage Control Procedure>

Figure 5:
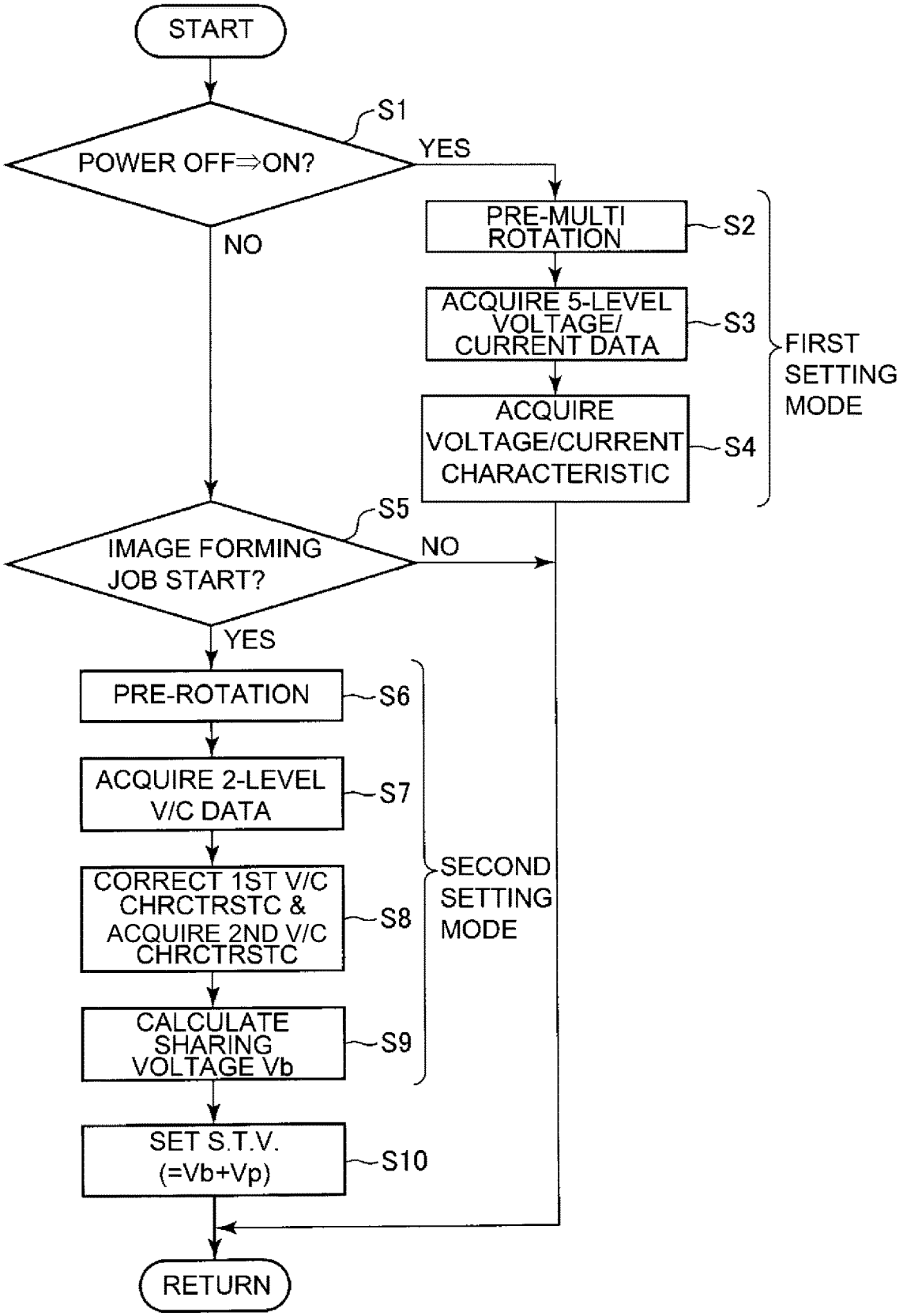
FIG. 5 is a flowchart showing an outline of a procedure of secondary transfer voltage control.

FIG. 5 is a flowchart showing an outline of the process of the secondary transfer voltage control in this embodiment.

When the power of the image forming apparatus 100 is turned on (S1), the control unit 50 starts the multiple pre-rotations after the power is turned on (S2). During the multiple pre-rotations, the control unit 50 executes the first setting mode using the five levels of test current or test voltage (S3) to acquire the first voltage-current characteristic approximated by the quadratic curve (S4)

In addition, when the control unit 50 receives a job start signal while the power is on (S5), it starts the pre-rotation (S6). And, the controller 50 executes the second setting mode using the two-level test current during the pre-rotation (S7), and corrects the first voltage-current characteristic acquired during the multiple pre-rotations based on the result to obtain the second voltage-current characteristics (S8). Next, based on the acquired second voltage-current characteristics, the control unit 50 obtains the secondary transfer partial voltage Vb corresponding to the target transfer current Itarget for each recording material P which reaches the secondary transfer unit T2 (S9). And, during secondary transfer, the control unit 50 applies, from the secondary transfer power source D2 to the secondary transfer roller 8 with constant voltage control, the secondary transfer voltage having the value obtained by adding the partial voltage Up of the recording material P depending on the type and amount of moisture of the recording material P to the secondary transfer partial voltage Vb (S10). Here, in this embodiment, the recording material part voltage Up is set in advance for each type of the recording material P according to the moisture content and stored in the ROM 53.

As described above, in this embodiment, the image forming apparatus 100 is provided with the detecting means 61 and 62 for detecting a current or voltage value when a voltage is supplied to the transfer portion T2 by the applying means D2. In addition, the image forming apparatus 100 includes the control unit 50 capable of setting a secondary transfer voltage in a preparing operation in the period after an image formation start instruction is received and before image formation is started. In this embodiment, the control means 50 can execute the first setting mode, in which before the above-described preparing operation, the test voltage or test current of 3 levels or more is applied to the transfer portion T2, and the first voltage-current characteristic is acquired on the basis of the detection results of the detection means 61 and 62 detected when the test voltage or test current is applied. In addition, in the above-described preparing operation, the control means 50 executes the second setting mode, in which the test voltage or test current at a level lower than that in the first setting mode is applied to the transfer unit T2, and the second voltage-current characteristic is obtained on the basis of the detection result of the detection means 61 and 62 detected when the test voltage or test current is supplied and on the first voltage-current characteristic. And, the control means 50 can set the transfer voltage based on the second voltage current characteristic. In this embodiment, the control means 50 executes the first setting mode when there is no toner image in the transfer unit T2, in a preparatory operation immediately after turning on the image forming apparatus 100, immediately after returning from the sleep state, or immediately after jam clearance operation. In addition, in this embodiment, the control unit 50 executes the second setting mode when there is no toner image in the transfer portion T2 in the above-described preparing operation from when an image formation start instruction is received until image formation is started. In this embodiment, the number of the test voltage or test current levels in the second setting mode is two, but it will suffice if it is less than the number of the levels of the test voltage or test current in the first setting mode.

In particular, in this example, the image bearing member 7 is an intermediary transfer member which carries the toner image transferred from another image bearing member 1 to be transferred onto the recording material P as a transfer target at the transfer portion T2. In addition, in this embodiment, the control unit 50 executes the first setting mode and the second setting mode when the recording material P as the transfer target does not pass through the transfer portion T2. And, in this embodiment, the control means 50 sets a voltage obtained by adding the partial transfer voltage Vb determined based on the second voltage-current characteristic and a preset recording material partial voltage Up as the transfer voltage. In addition, in this embodiment, the control means 50 obtains the first voltage current characteristic by approximating the detection results of the detection means 61 and 62 in the first setting mode with a quadratic curve. More specifically, in this embodiment, the control portion 50 obtains the value of the first voltage for supplying a predetermined first current to the transfer portion T2 on the basis of the detection results of the detection means 61 and 62 in the second setting mode. And, based on the ratio between the first current and the second current obtained by applying the first voltage to the first voltage-current characteristic, the control means 50 corrects the first voltage current characteristic to obtain the second voltage current characteristic.

As has been described in the foregoing, in this embodiment, in the second setting mode which is executed during the pre-rotation immediately before the start of image formation, the second voltage-current characteristic is acquired by correcting the first voltage-current characteristic acquired in the first setting mode executed during the multiple pre-rotations. By this, in the second setting mode which is executed during the pre-rotation immediately before the start of image formation, the second voltage-current characteristics can be acquired in a relatively short time and with the same accuracy as the first setting mode. Therefore, according to this embodiment, while improving the accuracy of setting an appropriate secondary transfer voltage, the time period from the input of the image formation start instruction to the output of the first recording material P on which the image is formed (FCOT) can be reduced.

Embodiment 2

Next, another embodiment of the present invention will be described. The basic structure and operation of the image forming apparatus of this embodiment are the same as those of the image forming apparatus of Embodiment 1. Therefore, in the image forming apparatus of this embodiment, elements including the same or corresponding functions or structures as those of the image forming apparatus of Embodiment 1 are denoted by the same reference numerals as those of Embodiment 1, and detailed description thereof is omitted.

Figure 6:
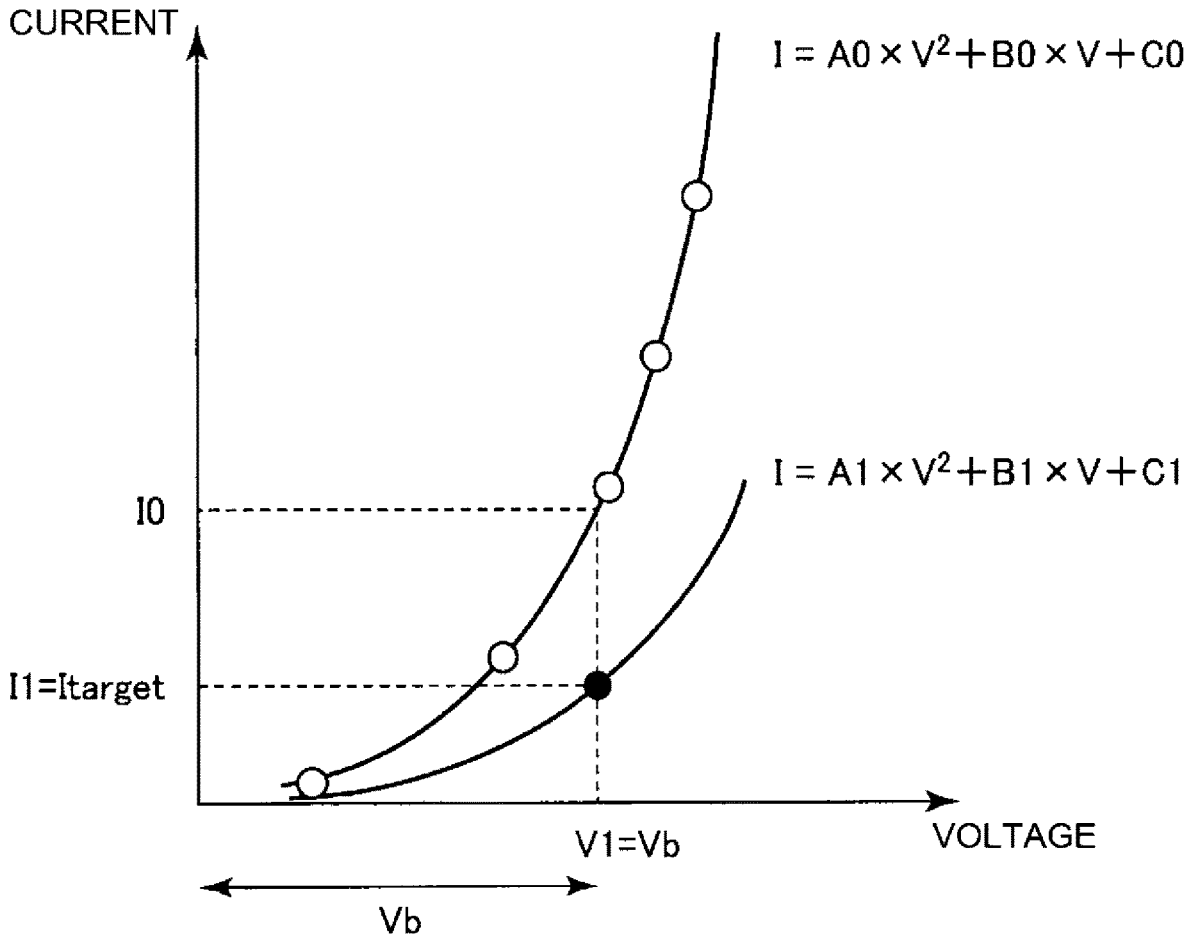
FIG. 6 is a graph for illustrating another example of an acquiring method of a second voltage-current characteristic in an operation in a second setting mode.

FIG. 6 is a graph for explaining a method for obtaining the voltage-current characteristics of the secondary transfer portion T2 in the second setting mode in this embodiment. In the Figure, a first voltage-current characteristic (white plot) obtained in the first setting mode and a second voltage-current characteristic (black plot) obtained in the second setting mode are shown.

In this embodiment, the second setting mode is executed using one level of test current. In this embodiment, in the control unit 50, the one-level test current I1 in the second setting mode is the target transfer current Itarget in the full color mode which is based on the information shown in Table 3 described in Embodiment 1, depending on the type of the first recording material P of the job and the amount of moisture. In addition, in this example, the controller 50 uses the voltage V1 detected by applying the test current I1 (=Itarget) as the secondary transfer partial voltage Vb. And, in this embodiment, the control unit 50 acquires the second voltage-current characteristic shown in Expression 5 in the same manner as in Embodiment 1, using these Itarget (=I1) and secondary transfer partial bearing voltage Vb (=V1) and the first voltage-current characteristic shown in Equation 1 obtained in the first setting mode. Here, the control unit 50 obtains the coefficients A1, B1, and C1 in Expression 5 using Expression 6, Expression 7, and Expression 8 as in Embodiment 1.

As has been described in the foregoing, according to this example, the same effects as those of Embodiment 1 can be provided, and the time required for acquiring the second voltage-current characteristics in the second setting mode which is executed immediately before the start of image formation can be further reduced as compared with Embodiment 1. Therefore, according to this embodiment, the time (FCOT) from the input of the image formation start instruction to the output of the first recording material P on which the image is formed can be further shortened as compared with Embodiment 1.

[Others]

As mentioned above, although this invention has been described with respect to the specific Embodiments, this invention is not limited to the above-mentioned Embodiments.

In the above-described embodiment, although the present invention is applied to the secondary transfer voltage control, the present invention may be applied to the primary transfer voltage control. That is, in another possible example, when there is no toner image in the primary transfer area, a test voltage or test current is supplied to the primary transfer area, the voltage-current characteristics which change according to the electrical resistance of the primary transfer portion (primary transfer member or intermediary transfer member) is acquired, and a primary transfer voltage is set based on the voltage-current characteristics. More specifically, by applying the predetermined transfer current value which is preset according to environmental conditions, and so on to the acquired voltage-current characteristics, said primary transfer voltage value to be applied by constant-voltage-control during primary transfer can be set. Regarding primary transfer voltage control, for example, if the setting mode using a test voltage or test current of 3 levels or more is executed during each pre-rotation, the productivity of image output may be adversely affected. Therefore, similarly to the secondary transfer voltage control, regarding primary transfer voltage control, the first setting mode is executed to acquire the first voltage-current characteristics, such as during the multiple pre-rotations immediately after turning on the power, and the second voltage current characteristic can be acquired by executing the second setting mode during the pre-rotation of the job. By this, similarly to the secondary transfer voltage control, in the second setting mode which is executed during the pre-rotation immediately before the start of image formation, the second voltage-current characteristic can be acquired in a relatively short time and with the same accuracy as in the first setting mode. Therefore, while improving the accuracy of setting an appropriate primary transfer voltage, it is possible to shorten the time period from when an image formation start instruction is input until the first recording material on which an image is formed is output.

In addition, in the above-described embodiment, the first setting mode is executed at the multiple pre-rotations immediately after turning on the power, but the first setting mode is not limited to being executed at the multiple pre-rotations immediately after turning on the power. For example, if the time after the last execution of the first setting mode is longer than the specified time, it is possible to execute the first setting mode at the time of the current multiple pre-rotations and to use the result of the first setting mode executed at the end, for example, at the time of the pre-rotation for the job. In addition, in the above-described embodiment, although the second setting mode is executed at the time of the pre-rotation of the job, it is not limited to executing the second setting mode at the time of the pre-rotation of the job. For example, if the elapsed time after the last execution of the second setting mode is longer than the specified time, when the number of images formed is greater than the specified number, or when the environmental fluctuations are more than the prescribed fluctuation range, the second setting mode may be executed during the current pre-rotation. And, if the second setting mode is not executed during the pre-rotation for the job, for example, it is possible to use the results of the second setting mode which has been last executed. In addition, when the number of images formed becomes equal to or greater than a predetermined number during continuous image formation, the transfer voltage may be corrected by executing the second setting mode even between adjacent sheets.

In addition, in the embodiment described above, the target transfer current Itarget and ΔI for determining the test current are set depending on the amount of water. However, the present invention is not limited to such an aspect, and if the appropriate transfer voltage setting is sensitive to at least one of the temperature and humidity, at least one of temperature and humidity can be used as environmental information.

In addition, in the above-described embodiment, the transfer voltage at the time of transfer is controlled at a constant voltage, but the transfer voltage may be controlled at a constant current (the output of the power supply is controlled so that the flowing current becomes substantially constant at the target value) Again, based on the second voltage-current characteristics obtained by executing the first and second setting modes, the current value corresponding to the target value of the preset transfer voltage value can be set, or the initial value of the voltage value corresponding to the target value of the preset transfer voltage current value can be set.

In addition, the transfer voltage is not limited to being always set through the first setting mode and the second setting mode. For example, if an image formation start instruction is inputted within a sufficiently short time (e.g. almost simultaneously) after turning on the power or returning from the sleep state, the transfer voltage of the job may be set based on the first voltage-current characteristic acquired in the first setting mode during the multiple pre-rotations. That is, for example, a voltage obtained by applying a predetermined transfer current set in advance according to the type of recording material, environment, and so on to the first voltage-current characteristic is set as the partial secondary transfer voltage. And, the secondary transfer voltage can be selected by adding a preset recording material part voltage according to the type and environment of the recording material to the partial secondary transfer voltage. That is, the control means 50 may be capable of executing the following first setting mode and second setting mode, respectively. The first setting mode may be such that immediately after turning on the power of the image forming apparatus, a test voltage or test current of three levels or more is supplied to the transfer unit, and the transfer voltage is set based on the detection result of the detection means detected when the test voltage or test current is supplied. In addition, the second setting mode is such that in a preparatory operation from when an image formation start instruction is received until image formation is started, a test voltage or test current at a level lower than that in the first setting mode is supplied to the transfer unit, and the test voltage or test current is supplied, and the transfer voltage is selected based on the detection result of the detection means. As described above, the same applies when the present invention is applied to the primary transfer portion.

According to the present invention, while improving the accuracy of setting an appropriate transfer voltage, it is possible to shorten the time from the input of the image formation start instruction to the output of the first recording material on which the image is formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-215112 filed on Nov. 15, 2018, which is hereby incorporated by reference herein in its entirety.

What is claimed is:

1. An image forming apparatus comprising:

an image bearing member configured to bear a toner image;

a transfer member configured to transfer the toner image from said image bearing member onto a toner image receiving member at a transfer portion;

an applying device configured to apply a transfer voltage, for transferring the toner image, to said transfer portion;

a sensor configured to detect a current or a voltage when the voltage is applied to said transfer portion by said applying device; and a controller configured to execute an operation in a first mode in which three or more levels of a first test voltage or three or more levels of a first test current are supplied to said transfer portion after main switch actuation before an image formation, and configured to execute an operation in a second mode in which a number of levels of a second test voltage or a number of levels of a second test current are supplied to said transfer portion in a preparatory period from a reception of an image formation start instruction until an image formation of a first sheet is started, the number of levels supplied in the second mode being less than that supplied in the first mode, and wherein the controller acquires a first voltage-current characteristic on the basis of a detection result of said sensor detected in the operation in the first mode, and acquires a second voltage-current characteristic on the basis of the first voltage-current characteristic and a detection result of said sensor detected in the operation in the second mode, and sets the transfer voltage on the basis of the second voltage-current characteristic.

2. An image forming apparatus according to claim 1, wherein the number of levels of the second test voltage or the second test current in the operation in the second mode is one or two.

3. An image forming apparatus according to claim 1, wherein said image bearing member is an intermediary transfer member configured to convey the toner image transferred from another image bearing member so as to transfer the toner image onto a recording material at said transfer portion.

4. An image forming apparatus according to claim 1, wherein said controller executes the operation in the first mode and the operation in the second mode when a recording material does not pass through said transfer portion, and sets, as the transfer voltage, a voltage which is a sum of a transfer portion sharing voltage determined on the basis of the second voltage-current characteristic and a recording material sharing voltage set in advance.

5. An image forming apparatus according to claim 1, wherein said controller acquires the first voltage-current characteristic by subjecting the detection result of said sensor in the operation in the first mode to approximation with a quadratic curve.

6. An image forming apparatus according to claim 1, wherein said controller acquires, on the basis of the detection result of said sensor in the operation in the second mode, a value of a first voltage for supplying a predetermined first current to said transfer portion, and said controller acquires the second voltage-current characteristic by correcting the first voltage-current characteristic on the basis of a ratio between the first current and a second current acquired by applying the first voltage to the first voltage-current characteristic.

* * * * *